US006378723B1

(12) United States Patent
Casey

(10) Patent No.: US 6,378,723 B1
(45) Date of Patent: Apr. 30, 2002

(54) CONTAINER HAVING BOTTOM LUG FOR RADIAL POSITIONING AND BOTTOM MOLD THEREFOR

(76) Inventor: J. P. Casey, 407 Kings Walk, Douglasville, GA (US) 30134

( * ) Notice: Subject to any disclaimer, the term of this patent is extended or adjusted under 35 U.S.C. 154(b) by 0 days.

(21) Appl. No.: 09/498,786

(22) Filed: Feb. 5, 2000

(51) Int. Cl.[7] ..... B65D 6/28

(52) U.S. Cl. ..... 220/608; 53/51; 215/371; 220/623

(58) Field of Search ..... 220/608, 623, 220/609, 624, 574; 215/373, 374, 375, 377, 371; 53/51

(56) References Cited

U.S. PATENT DOCUMENTS

| | | | | | |
|---|---|---|---|---|---|
| 3,139,824 | A | * | 7/1964 | Derrickson | 101/124 |
| 3,363,546 | A | * | 1/1968 | Johnson | 101/38.1 |
| 3,468,443 | A | * | 9/1969 | Marcus | 215/375 |
| 3,871,541 | A | | 3/1975 | Adomaitis | |
| 3,973,941 | A | | 8/1976 | Augeri | |
| 4,054,219 | A | * | 10/1977 | Young et al. | 215/375 |
| 4,108,324 | A | | 8/1978 | Krishnakumar et al. | |
| 4,247,012 | A | | 1/1981 | Alberghini | |
| 4,280,612 | A | * | 7/1981 | Nagano | 198/379 |
| 4,298,567 | A | | 11/1981 | Aoki | |
| 4,364,721 | A | | 12/1982 | Rainsville | |
| 4,457,688 | A | | 7/1984 | Calvert et al. | |
| 4,502,607 | A | | 3/1985 | Szjana | |
| 4,900,504 | A | | 2/1990 | Fischer | |
| 4,927,679 | A | | 5/1990 | Beck | |
| 5,058,737 | A | * | 10/1991 | Patterson et al. | 220/574 |
| 5,080,244 | A | * | 1/1992 | Yoshino | 220/609 |
| 5,201,984 | A | * | 4/1993 | Bedin | 156/566 |
| 5,398,485 | A | * | 3/1995 | Osifchin | 53/490 |
| 5,449,087 | A | * | 9/1995 | Mikula et al. | 220/608 |
| 5,549,210 | A | | 8/1996 | Cheng | |
| 5,551,592 | A | * | 9/1996 | Barton et al. | 220/571 |
| 5,655,658 | A | * | 8/1997 | Saveliev et al. | 206/407 |
| 5,714,111 | A | | 2/1998 | Beck et al. | |
| 5,732,838 | A | | 3/1998 | Young | |
| 5,763,030 | A | | 6/1998 | Matsui | |
| 5,806,410 | A | * | 9/1998 | Muchin et al. | 220/574 |
| 5,850,931 | A | | 12/1998 | Young et al. | |
| 5,934,042 | A | * | 8/1999 | Peronek | 53/317 |
| 5,989,661 | A | * | 11/1999 | Krishnakumar et al. | 428/35.7 |
| D418,414 | S | | 1/2000 | Cheng et al. | |

FOREIGN PATENT DOCUMENTS

| | | | | |
|---|---|---|---|---|
| BE | 524306 | * | 3/1956 | 215/377 |

* cited by examiner

*Primary Examiner*—Stephen P. Garbe
*Assistant Examiner*—Joseph C. Merek
(74) *Attorney, Agent, or Firm*—Pepe & Hazard LLP

(57) ABSTRACT

A locating lug positioned on the bottom of a container for bi-directionally indexing the container to a desired orientation to facilitate the addition of labels, decoration and/or other functions on said container. The container having a lug defined by a first horizontal wall, two vertical walls and a wall generally angled toward the center. The lug is radially offset from the center and has vertical engagement side walls of sufficient length and height to ensure positive engagement with a locating pin. In use, the container is placed within a recessed area formed in abase cup. A spring loaded pin is positioned radially off center within the recessed area. The pin is then rotated until the pin engages either one of the vertical walls, upon which the rotation of the container begins, thus indexing the container into position for applying decoration, ornamentation, labels or for other means as needed.

8 Claims, 6 Drawing Sheets

CONTAINER HAVING BOTTOM LUG FOR RADIAL POSITIONING AND BOTTOM MOLD THEREFOR

TECHNICAL FIELD

The present invention relates generally to bottles and containers, and, more specifically, to a locating lug for positioning a container and bottom mold therefor.

BACKGROUND

Hollow containers, including bottles, cups, glasses, bowls and the like, are utilized for a multitude of applications. Because of the enormous popularity and utilitarian benefit of containers, numerous improvements have been proposed for their formation.

One typical method of forming hollow containers is via a widely utilized process known as stretch blow-molding, wherein typically a three piece mold having two opposing side members and a bottom/push-up mold is utilized. Commonly, an injection molded preform, shaped generally like a test tube (also known as the parison), is inserted into the top of the mold. A rod is inserted inside the parison and is utilized to extend the parison to the bottom of the mold, upon which compressed air is forced into the parison, thus stretching the parison outward first toward the approximate center of the side mold members and then over and around the push-up/bottom mold. The parison is generally amorphous prior to initiating the blow process; however, after stretching the parison, the molecules align thereby forming a container having high tensile strength.

Once a container is formed, it is often necessary or desired to rotate the container to a desired position to apply decoration, ornamentation, labels or for other purposes. Under the prior art method (as shown in FIG. 7–8), a container having two upwardly recessed ramp areas, as viewed from the bottom of the container, is formed, wherein the container is placed on a base member having a recessed area formed therein for receiving the bottom of the container. Positioned within the recessed area of the base and extending vertically upward therefrom is typically a spring loaded pin. The base is rotated until the pin engages within one of the recessed ramp areas formed on the bottom of the container.

This method has many disadvantages. For instance, because the lugs are raised into the interior of the container, the lugs interfere with the stretching of the parison. In other words, because the parison must extend over and past the raised lugs, the area near the peripheral bottom edges of the container, known as the chime area, results in a reduced wall thickness and thus weakened container. In addition, the container is often rotated at a relatively high speed, and consequently, the spring loaded pin will often miss or jump over the prior art upwardly recessed ramp areas, resulting in inefficient and inaccurate indexing of the container. Moreover, under the prior art method, two upwardly recessed ramp areas facing opposite directions must be utilized to ensure proper operation with various rotating mechanism. More specifically, due to various industry designs, some rotating mechanisms rotate clockwise while others rotate counterclockwise.

It is therefore readily apparent that a new and improved container having a locating lug positioned on the bottom of the container is needed that does not interfere with the blow-molding process, has a larger and more dependable engagement surface and is bi-directional, thereby allowing it to be utilized with various rotating mechanisms. It is, therefore, to the provision of such an improvement that the present invention is directed.

BRIEF SUMMARY OF THE INVENTION

Briefly described, in a preferred embodiment, the present invention both overcomes the above-mentioned disadvantages, and meets the recognized needs for such device, buy providing a locating lug positioned on the bottom of a container for indexing the container to a desired orientation to facilitate the addition of labels, decoration and/or other necessary functions on said container.

The preferred embodiment of the present invention generally comprises a container having a lug defined by a first horizontal wall, two vertical walls and a generally angled wall. The lug is preferably radially offset from the center and has vertical engagement side walls of sufficient length and depth to ensure positive engagement with a locating pin.

In use, the container is placed within a recessed area formed in a base cup. A spring loaded pin is positioned radially off center within the recessed area. The pin is then rotated until the pin engages either one of the vertical walls, upon which the container begins to rotate, thus indexing the container into position for applying decoration, ornamentation, labels or for other means as needed. Because of the two opposing vertical walls of the lug, the container may be rotated in either direction.

Additionally, because the lug is recessed downward from the bottom of the container, the lug formation does not interfere with the blow-molding process, thus increasing the production window. As a result, a more uniform wall thickness in the chime area is achieved.

Consequently, a feature and advantage of the present invention is to provide a container having a new and improved bottom lug for positioning the container in a desired radial position to facilitate the application of ornamentation or other insignia.

A feature and advantage of the present invention is to provide a container having a new and improved bottom lug that is non-active in the maintenance of uniform wall thickness in the chime area of blown containers.

A feature and advantage of the present invention is to provide a container having a new and improved bottom lug that aids in ensuring a flat setting surface through decreased distortion of the chime area.

A feature and advantage of the present invention is to provide a container having a new and improved bottom lug that has a relatively large and accessible engagement surface that is open and more easily engaged than prior-art ramps and spot locators.

A feature and advantage of the present invention is to provide a container having a new and improved singular bottom lug that is bi-directional.

A feature and advantage of the present invention is to provide a container having a new and improved bottom lug that aids in the reduction of gate fracture in plastic and bottom breakage in glass.

A feature and advantage of the present invention is to provide a bottom mold for molding a container having a new and improved bottom lug for positioning the container in a desired radial position to facilitate the application of ornamental or other insignia.

A feature and advantage of the present invention is to provide a bottom mold that allows for greater freedom in mold design, height and configuration of the pushup.

A feature and advantage of the present invention is to provide a bottom mold that is more easily constructed than prior art molds.

These and other objects, features and advantages of the present invention will become more apparent to one skilled in the art by reference to the following detailed description of the preferred and alternate embodiments, the appended claims, and the accompanying drawings.

BRIEF DESCRIPTION OF THE FIGURES

The present invention will be better understood by reading the Detailed Description of the Preferred Embodiment with reference to the accompanying drawing figures, in which like reference numerals denote similar structure and refer to like elements throughout, and in which.

DETAILED DESCRIPTION OF THE PREFERRED EMBODIMENT

In describing the preferred and alternate embodiments of the present invention illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand making, may be provided in association with the present invention, all without departing from the scope of the invention.

In the preferred embodiment, the present invention generally comprises container 5 with a wedge-shaped lug 10 which depends from the generally dome-shaped bottom wall 110 having a concave lower surface 112. Although in the preferred embodiment, container 5 is described as a bottle formed from blow-molded plastic, container 5 may be any one of many known containers such as, for exemplary purposes only, bottles, cups, glasses and bowls.

Figure 1:
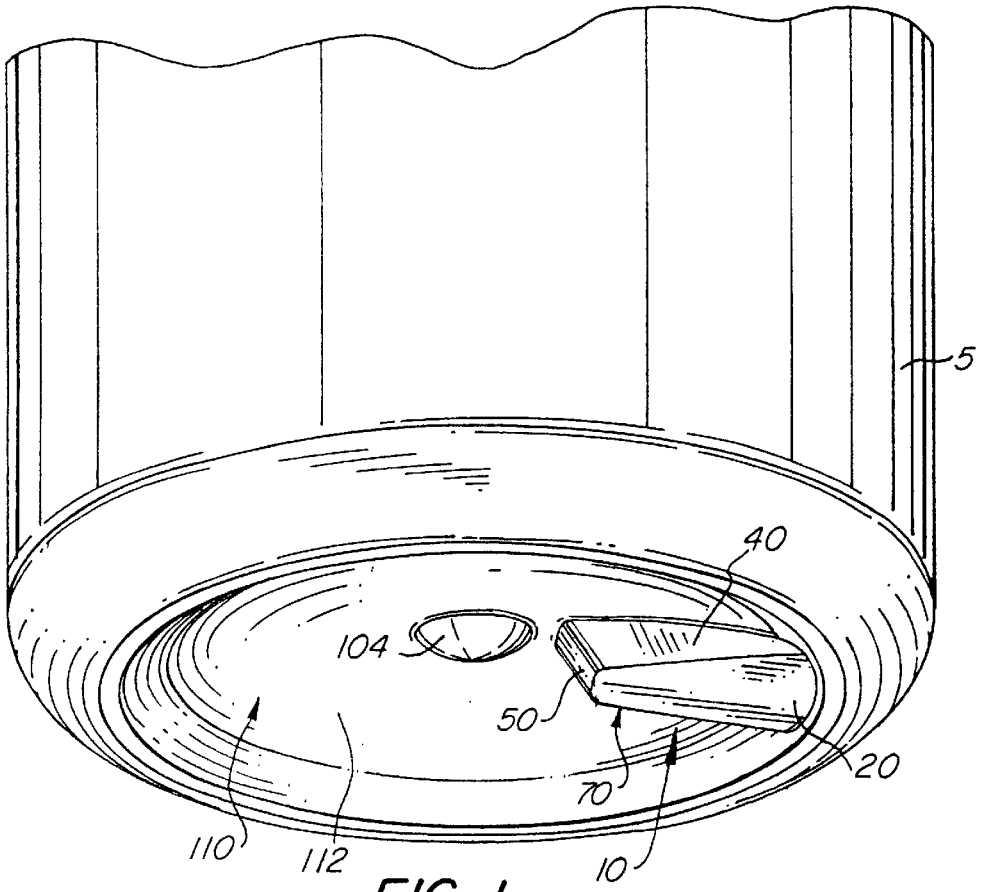
FIG. 1 is a bottom perspective view of the container according to the preferred embodiment of the present invention.
Figure 2:
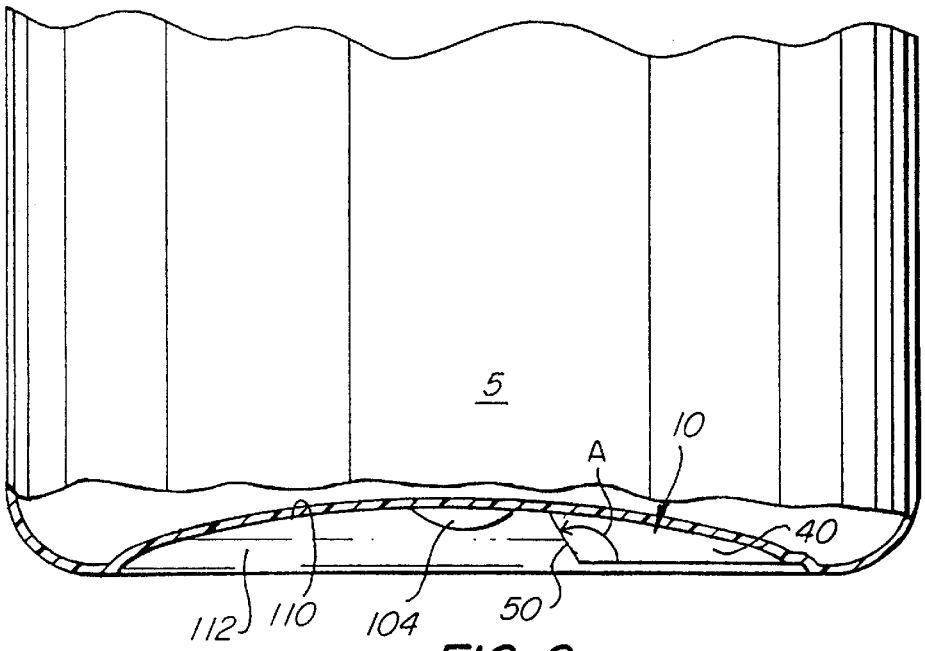
FIG. 2 is a partial cutaway side view of the container according to the preferred embodiment of the present invention.
Figure 3:
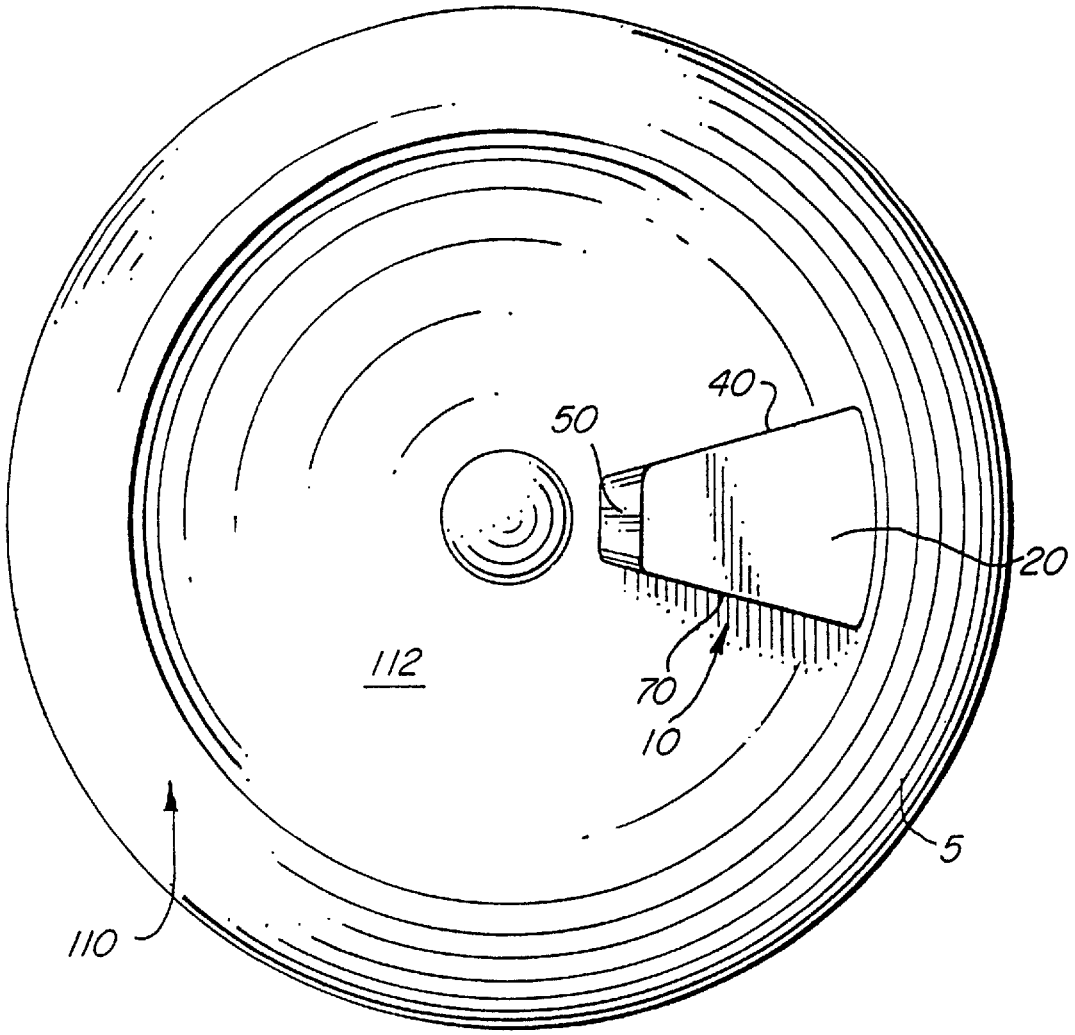
FIG. 3 is a bottom view of the container according— referred embodiment of the present invention.

Referring now to FIGS. 1–3, lug 10 is generally a four-wall member extending downwardly from the dome-shaped bottom wall of container 5. Lug 10 is preferably radially offset from the center and has vertical engagement side walls of sufficient length to ensure positive engagement with a locating pin, as more fully described below.

Wedge-shaped lug 20 is formed with a pair of radially extending, generally vertical side walls 40, 70, a generally planar transverse wall 20 extending therebetween and inner end wall 50. As can be seen, the lug 20 extends inwardly from adjacent the periphery of the bottom wall 110 and terminates adjacent to but spaced from the center boss 104 formed by the push rod. The side walls 40, 70 are substantially vertical and the inner end wall 50 slopes downwardly from the transverse wall 20 towards the concave lower surface 112. The end wall 50 is also concave in cross-section. Therefore, as engagement walls, the side wall 40 and the side wall 70 provide reliable generally perpendicular surfaces for contacting an indexing pin P, as more fully described below.

In continuing reference to FIG. 2, end wall 50 preferably extends from the transverse wall 20 at an approximate angle A of 125 degrees. In alternate embodiments, angle A can range from less than 90 degrees to approximately 180 degrees. However, it is normally preferred that angle A range between approximately 120 degrees and 150 degrees, thereby allowing for better material distribution during the blow-mold process. It should also be noted that the radial width of lug 10 is preferably minimal to prevent bottom interference but is sufficient to allow proper material distribution and shape retention.

Figure 4:
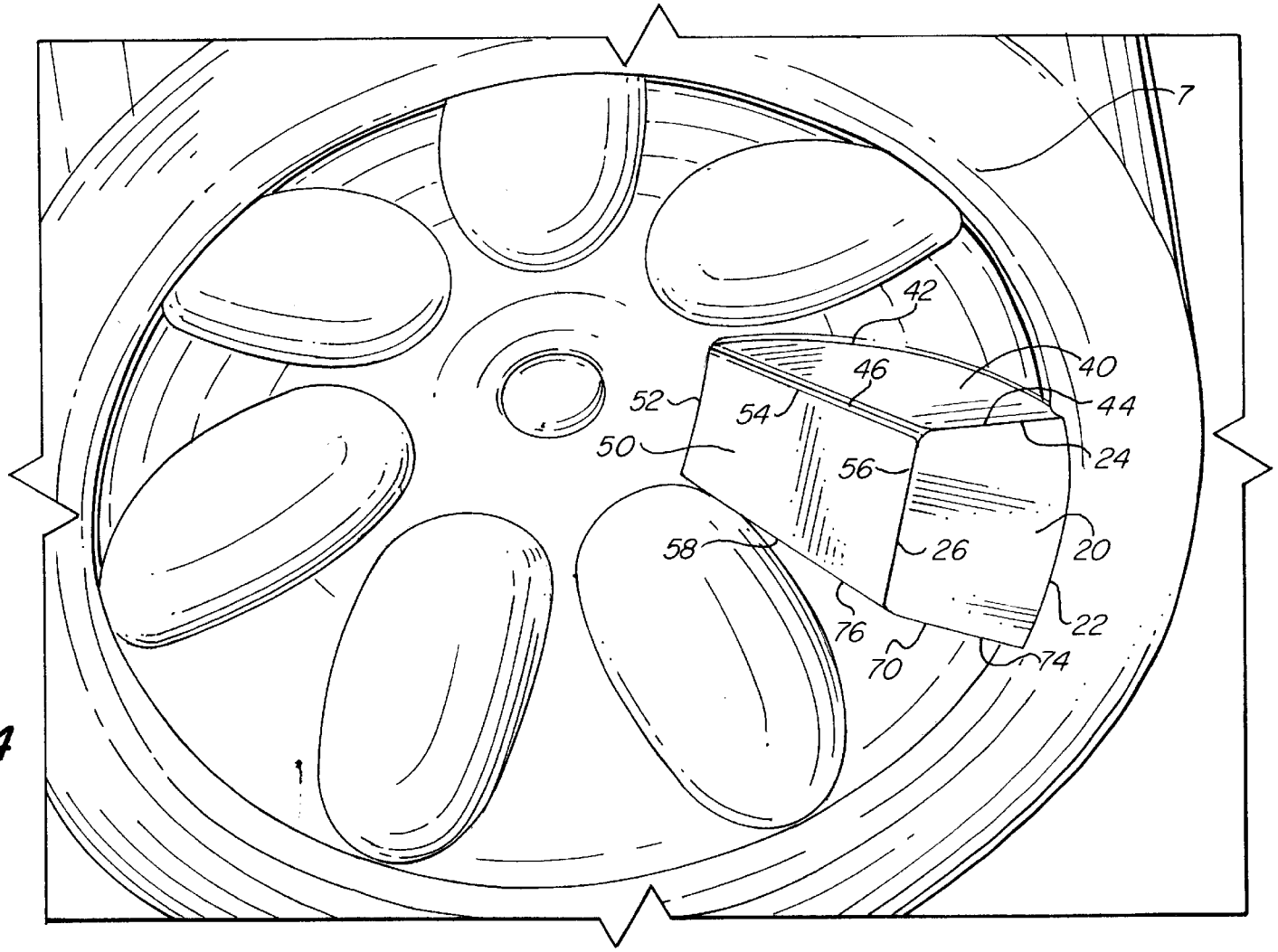
FIG. 4 is a bottom perspective view of the container according to an alternate embodiment of the present invention.

It should be noted that in an alternate form, as shown in FIG. 4, lug 10 is formed on container 7, wherein container 7 has a plurality of ribs formed on the bottom for providing supplemental structural support. Lug 10 is suitable for such use without significantly interfering with the ribs. Such ribbed bottoms are well known within the art.

Figure 6:
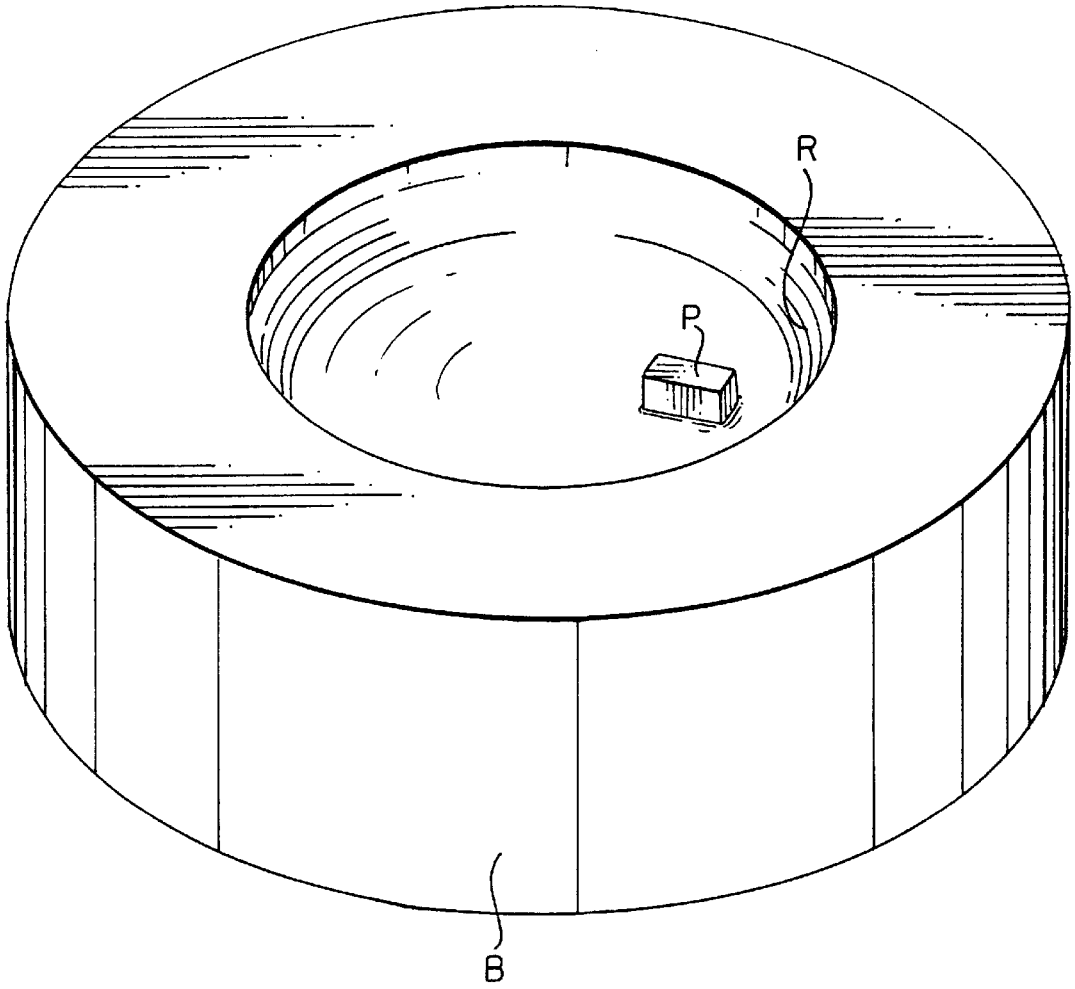
FIG. 6 is a top perspective view of a base cup and locating pin for use with the present invention.
Figure 7:
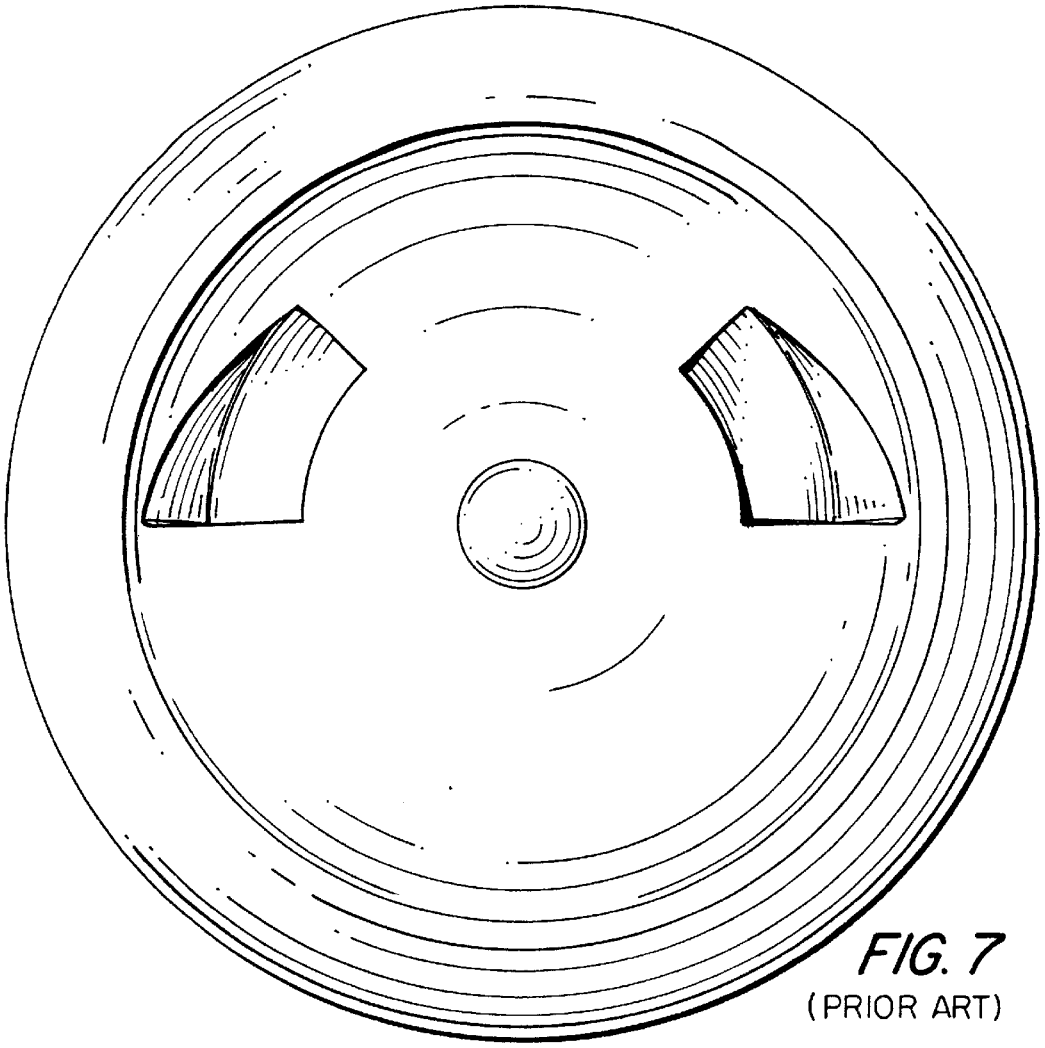
FIG. 7 (PRIOR ART)
FIG. 7 is a bottom view of a prior-art device.
Figure 8:
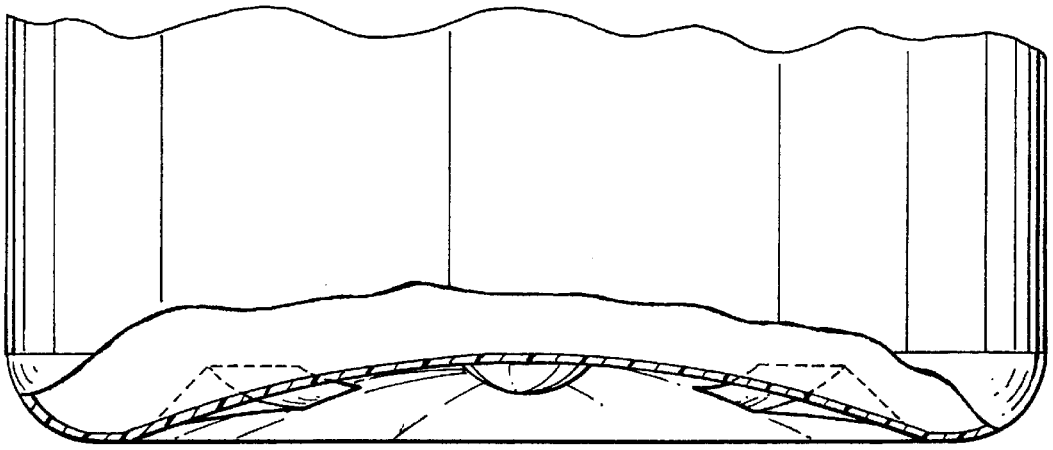
FIG. 8 (PRIOR ART)
FIG. 8 is a partial cutaway side view of a prior-art device.

In use, referring now to FIG. 6, container 5 is placed on a base B within recessed area R. A spring loaded pin P is positioned radially off center within recessed area R. Base B is then rotated until pin P engages either second wall 40 or side wall 70, wherein the rotation of container 5 is initiated, thus indexing container 5 into position for applying decoration, ornamentation, labels or for other means as needed. Because side wall 40 and side wall 70 are formed on opposing sides of lug 10, container 5 may be rotated in either direction.

Figure 5:
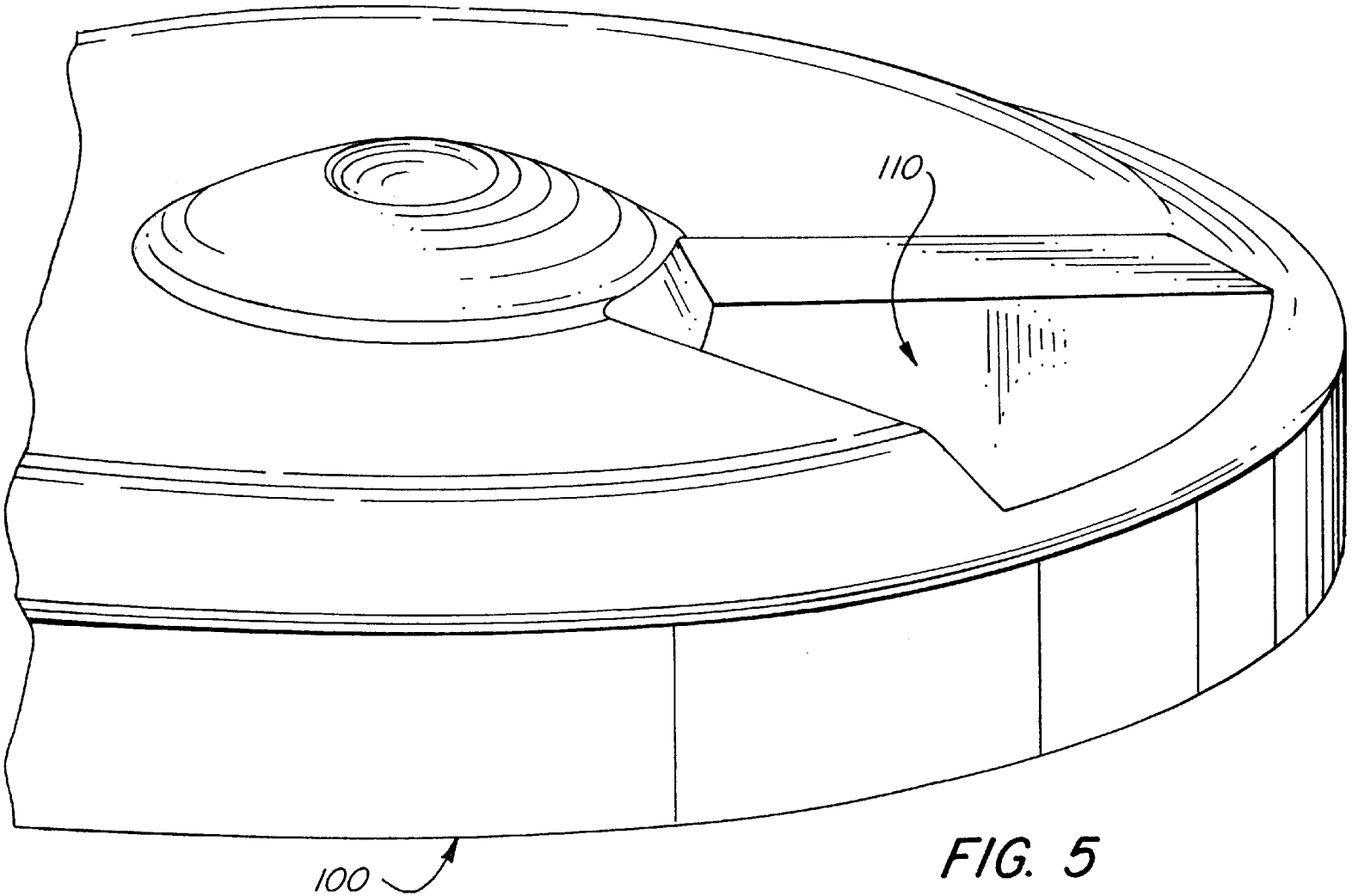
FIG. 5 is a top perspective view of the mold push-up according to the preferred embodiment of the present invention.

Now referring to FIG. 5, for exemplary purposes only, one method of forming a hollow container such as container 5 is by a widely utilized process known as stretch blow-molding, wherein typically a three piece mold having two opposing side members and a bottom/push-up mold is utilized. Commonly, an injection molded preform, shaped generally like a test tube (also known as the parison), is inserted into the top of the mold. A rod is inserted inside the parison and is utilized to extend the parison to the bottom of the mold, upon which compressed air is forced into the parison thus stretching the parison outward first toward the approximate center of the side mold members and then over and around the push-up/bottom mold. The parison is generally amorphous prior to initiating the stretch and blow process; afterwards, however, the molecules are aligned thereby forming a container having high tensile strength.

By utilizing push-up 100, as disclosed herein, in combination with one of many known side models and preforms, container 5 having lug 10 can be formed. More specifically, push-up 100 is preferably a circular member having recessed lug forming portion 110. However, in alternate embodiments, push-up 100 may have other shapes as needed. Recessed lug forming portion 110 is cut or molded into push-up 100 in the same shape and form as described above for lug 10. During the blow-molding process, the parison is stretched over and into recessed lug forming portion 110, thereby forming the bottom of container 5 and thus lug 10.

It should be noted that container 5 having lug 10 can be formed through other known methods for forming hollow containers such as, for exemplary purposes only, extrusion blow molding, injection blow molding, vacuum molding, rotary molding or injection molding. It should also be noted that the material used to form container 5 and lug 10 is not limited to PET, other known materials may be utilized.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims. 100 may have other shapes as needed. Recessed lug forming portion 110 is cut or molded into push-up 100 in the same shape and form as described above for lug 10. During the blow-molding process, the parison is stretched over and into recessed lug forming portion 110, thereby forming the bottom of container 5 and thus lug 10.

It should be noted that container 5 having lug 10 can be formed through other known methods for forming hollow containers such as, for exemplary purposes only, extrusion blow molding, injection blow molding, vacuum molding, rotary molding or injection molding. It should also be noted that the material used to form container 5 and lug 10 is not limited to PET, other known materials may be utilized.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A readily indexable bottle having:

(a) a generally dome shaped bottom wall with a generally concave lower surface; and (b) a side wall extending upwardly from the periphery of said bottom wall, said bottom wall having only one generally wedge-shaped positioning lug formed therein and depending from said concave lower surface, said lug extending radially from adjacent said periphery of said bottom wall to a point spaced from the center of said bottom wall, the side walls of said lug being substantially vertical and extending radially, the vertical dimension of said side walls increasing towards said center but being no greater than the distance between the adjacent lower surface and the plane defined by the lower surface of the periphery of said bottom wall, said lug also having a transverse wall extending between said side walls and an end wall at the end thereof adjacent said center of said bottom wall.

2. The bottle in accordance with claim 1 wherein said side wall of said bottle is generally cylindrical.

3. The bottle in accordance with claim 1 wherein said transverse wall of said lug is substantially planar.

4. The bottle in accordance with claim 1 wherein said inner end wall of said lug slopes from said transverse wall towards said concave inner surface.

5. The bottle in accordance with claim 4 wherein said inner end wall is concavely arcuate in cross section.

6. The bottle in accordance with claim 1 wherein said bottom wall has a depending, generally circular protrusion at its center, said lug inner end wall being spaced from said protrusion.

7. The bottle in accordance with claim 6 wherein said bottle is blow molded from synthetic resin.

8. The bottle in accordance with claim 7 wherein the synthetic resin in said bottle is oriented in the side wall and in said bottom wall outwardly of said protrusions.

* * * * *